US008294624B2

(12) United States Patent
Yamamoto et al.

(10) Patent No.: US 8,294,624 B2
(45) Date of Patent: Oct. 23, 2012

(54) AUTOMOBILE GLASS ANTENNA AND AUTOMOBILE WINDOW GLASS SHEET

(75) Inventors: Tsuyoshi Yamamoto, Tokyo (JP); Masaki Ito, Tokyo (JP); Akio Nagata, Tokyo (JP); Mitsurou Watanabe, Tokyo (JP)

(73) Assignee: Asahi Glass Company, Limited, Tokyo (JP)

( * ) Notice: Subject to any disclaimer, the term of this patent is extended or adjusted under 35 U.S.C. 154(b) by 170 days.

(21) Appl. No.: 12/654,151

(22) Filed: Dec. 11, 2009

(65) Prior Publication Data

US 2010/0156730 A1 Jun. 24, 2010

Related U.S. Application Data

(63) Continuation of application No. PCT/JP2008/060707, filed on Jun. 11, 2008.

(30) Foreign Application Priority Data

Jun. 12, 2007 (JP) ..... 2007-155400
Aug. 28, 2007 (JP) ..... 2007-221214

(51) Int. Cl.
*H01Q 1/32* (2006.01)

(52) U.S. Cl. ..... 343/713; 343/711

(58) Field of Classification Search ..... 343/711, 343/713

See application file for complete search history.

(56) References Cited

U.S. PATENT DOCUMENTS 6,870,509 B2 * 3/2005 Ooe et al. ..... 343/711
2005/0128161 A1 * 6/2005 Kagaya et al. ..... 343/867
2005/0231432 A1 10/2005 Tsurume et al.
2006/0077109 A1 4/2006 Baba et al.
2007/0279301 A1 * 12/2007 Hoffmeister et al. ..... 343/713

FOREIGN PATENT DOCUMENTS

| | | | |
|---|---|---|---|
| JP | 10-013127 | A | 1/1998 |
| JP | 10-093317 | A | 4/1998 |
| JP | 10-303625 | A | 11/1998 |
| JP | 11-195915 | A | 7/1999 |
| JP | 11-234018 | A | 8/1999 |
| JP | 2001-044729 | A | 2/2001 |
| JP | 2005-101809 | A | 4/2005 |
| JP | 2005-303946 | A | 10/2005 |
| JP | 2006-101386 | A | 4/2006 |
| JP | 2006-197184 | A | 7/2006 |
| WO | WO 2005055360 | A1 * | 6/2005 |

OTHER PUBLICATIONS

International Search Report mailing date of Sep. 22, 2008 for International Application No. PCT/JP2008/060707.

* cited by examiner

*Primary Examiner* — Dieu H Duong
(74) *Attorney, Agent, or Firm* — Foley & Lardner LLP

(57) ABSTRACT

An automobile glass antenna which improves the antenna gain, is provided.

The automobile glass antenna has an H-band antenna conductor 3 connected with an H-band feeding portion 12 and extending in the transverse direction to receive high frequency band; an independent conductor that is separated from the H-band antenna conductor 3 and not connected with the H-band feeding portion 12 in terms of direct current, is provided in or on a side window glass sheet 20; the independent conductor has a first antenna element 1 extending in a vertical direction and second antenna elements 2 extending in a transverse direction; the first antenna element 1 and the second antenna elements 2 constitute a cross-shaped antenna element; and the H-band antenna conductor 3 and the independent conductor are capacitively coupled.

21 Claims, 7 Drawing Sheets

AUTOMOBILE GLASS ANTENNA AND AUTOMOBILE WINDOW GLASS SHEET

TECHNICAL FIELD

The present invention relates to an automobile glass antenna and an automobile glass sheet suitable for receiving a high frequency band such as an FM broadcast band or a low frequency band such as an AM broadcasting band.

BACKGROUND ART

Heretofore, as a glass antenna to be provided on an automobile side window glass sheet for receiving an FM broadcast band, a glass antenna has been employed, wherein a feeding portion 12 for FM broadcast band is connected with an antenna conductor 31 for FM broadcast band on a side window glass sheet 20 as shown in FIG. 10. In FIG. 10, a numeral 21 represents an automobile body opening edge of the window, and a numeral 20*a* represents an outer periphery of the side window glass sheet.

Further, as a glass antenna for receiving an AM broadcast band and an FM broadcast band provided on a window side glass sheet, a glass antenna is employed, wherein a feeding portion 11 for AM broadcast band and a feeding portion 12 for FM broadcast band are connected with an antenna conductor for AM broadcast band and an antenna conductor for FM broadcast band, respectively, on a side window glass sheet 20 as shown in FIG. 11.

Further, as a glass antenna for receiving the AM broadcast band and the FM broadcast band and provided on a side window glass sheet, glass antennas described in JP-A-10-13127, JP-A-11-195915, JP-A-2001-44729, JP-A-10-303625 and JP-A-11-234018, are known.

DISCLOSURE OF THE INVENTION

Problems to be Solved by the Invention

A side window glass sheet has a smaller area than a rear window glass sheet, and considering the securement of a field of view and appearance, the area for providing a glass antenna is limited. Particularly, since antenna conductors for FM broadcast band and AM broadcast band require a certain conductor area, it is difficult to obtain a sufficient receiving performance with a side window glass plane of an automobile.

It is an object of the present invention to provide a new glass antenna for an automobile and a new automobile window glass sheet that solve the above problems and improve an antenna gain.

Means for Solving the Problem

The present invention has the following gist.

(1) A glass antenna for an automobile, which is a glass antenna provided in or on an automobile window glass sheet, and which comprises an H-band antenna conductor for receiving electric waves in a high frequency band, an H-band feeding portion that is connected with the H-band antenna conductor in terms of direct current and provided in the vicinity of an automobile body opening edge on the left or right side of the window glass sheet and an independent conductor, separately from the H-band antenna conductor, that is not connected with the H-band feeding portion in terms of direct current is provided in or on the window glass sheet; wherein the H-band antenna conductor is provided outside the independent conductor and capacitively coupled with at least a part of antenna elements forming an outline of the independent conductor; the independent conductor comprises a first antenna element extending in a vertical direction or substantially in the vertical direction and a plurality of second antenna elements extending in a transverse direction or substantially in a transverse direction; and the first antenna element extends vertically across the plurality of second antenna elements in the vicinity of the center in a left-right direction so as to be connected with each of the second antenna elements.

(2) The glass antenna for an automobile according to the above (1), wherein the H-band antenna conductor has an extension portion extending upwardly along the outline of the independent conductor from the H-band feeding portion, and the extension portion is capacitively coupled with the independent conductor.

(3) The glass antenna for an automobile according to the above (1) or (2), wherein the independent conductor further comprises a single or a plurality of first vertical auxiliary antenna elements provided between the first antenna element and the H-band feeding portion and extending in parallel or substantially in parallel with the first antenna element, and the first vertical auxiliary antenna elements extend vertically across the plurality of second antenna elements to be connected with each of the second antenna elements.

(4) The glass antenna for an automobile according to the above (3), wherein the independent conductor further comprises a single or a plurality of transverse auxiliary antenna elements extending in parallel or substantially in parallel with the second antenna elements from a portion of the window glass sheet in the vicinity of the automobile body opening edge on the side of the glass sheet on which the H-band feeding portion is provided, to the first vertical auxiliary antenna element or the first antenna element.

(5) The glass antenna for an automobile according to the above (4), wherein the independent conductor further comprises a third antenna element extending in the vertical direction or substantially in the vertical direction so as to connect at least two of: the ends or their vicinities on the H-band feeding portion side of the plurality of second antenna elements and the ends or their vicinities on the H-band feeding portion side of the single or the plurality of vertical auxiliary antenna elements, to each other.

(6) The glass antenna for an automobile according to the above (5), wherein the third antenna element has a discontinuous portion at least one of adjacent connections in the at least two connections with the ends or their vicinities on the H-band feeding portion side of the plurality of second antenna elements and the ends or their vicinities on the H-band feeding portion side of the transverse auxiliary antenna elements.

(7) The glass antenna for an automobile according to any one of the above (1) to (6), wherein the plurality of second antenna elements are provided in the vicinity of the upper end or in the vicinity of the lower end of the window glass sheet other than the vicinity of the center in the vertical direction.

(8) The glass antenna for an automobile according to any one of the above (1) to (7), wherein the independent conductor further comprises a single or a plurality of second vertical auxiliary antenna elements provided in a region of the window glass sheet opposite to the H-band feeding portion across the first antenna element and extending in parallel or substantially in parallel with the first antenna element, and the second vertical auxiliary antenna elements extend vertically across the plurality of second antenna elements to be connected with each of the second antenna elements.

(9) The glass antenna for an automobile according to any one of the above (1) to (8), wherein the H-band antenna conductor is a loop-shaped conductor having a loop shape or a loop-shaped conductor constituting a loop shape in combination with the H-band feeding portion.

(10) The glass antenna for an automobile according to any one of the above (1) to (9), wherein provided that the wavelength at the central frequency of the high frequency band in the air is $\lambda_0$, the shortening coefficient of wavelength by glass is k, the formula of k=0.64 is established, the formula of $\lambda_g=\lambda_0 \cdot k$ is established, and a portion wherein the H-band antenna conductor is capacitively coupled with the independent conductor is designated as a capacitive coupling portion, then, the length of the capacitive coupling portion is from $0.05 \cdot \lambda_g$ to $0.2 \cdot \lambda_g$.

(11) The glass antenna for an automobile according to any one of the above (1) to (10), wherein provided that the wavelength at the central frequency of the high frequency band in the air is $\lambda_0$, the shortening coefficient of wavelength by glass is K the formula of k=0.64 is established, the formula of $\lambda_g=\lambda_0 \cdot k$ is established, then, the conductor length of the second antenna element from the first antenna element to the vicinity of the H-band feeding portion is $(1/11)\lambda_g$ to $(1/4)\lambda_g$.

(12) The glass antenna for an automobile according to any one of the above (1) to (11), wherein provided that the wavelength at the central frequency of the high frequency band in the air is $\lambda_0$, the shortening coefficient of wavelength by glass is k, the formula of k=0.64 is established, the formula of $\lambda_g=\lambda_0 \cdot k$ is established, then, the total length of the conductor length of the H-band antenna conductor, that is defined as the conductor length to the turning point of the loop shape when the H-band antenna conductor is a loop-shaped conductor, and the length of an AV line, that is connected with the H-band feeding portion, is from $(1/8)\lambda_g$ to $(1/2)\lambda_g$.

(13) The glass antenna for an automobile according to any one of the above (1) to (12), wherein the independent conductor is an L-band antenna conductor for receiving electric waves in a low frequency band having a lower frequency than the high frequency band, and the glass antenna further comprises an L-band feeding portion that connected with the L-band antenna conductor in terms of direct current and provided in proximity to the H-band feeding portion.

(14) The glass antenna for an automobile according to the above (13), wherein the minimum distance between the H-band feeding portion and the L-band feeding portion is from 3 to 50 mm.

(15) A window glass sheet for an automobile provided with the glass antenna as defined in any one of the above (1) to (14).

EFFECTS OF THE INVENTION

In the present invention, even in an automobile side window glass sheet having a small area, the antenna gain is drastically improved in a high frequency band such as the FM broadcast band as compared with conventional glass antennas. Further, as compared with conventional glass antennas, the antenna gain is improved in a frequency band from the central frequency of the high frequency band to a higher region, and the glass antenna of the present invention is excellent in the flatness of the antenna gain in the high frequency band. Further, the antenna gain is drastically improved in the AM broadcast band as compared with conventional glass antennas. Further, it becomes possible to obtain a good field of view.

EXPLANATION OF NUMERALS

Figure 1:
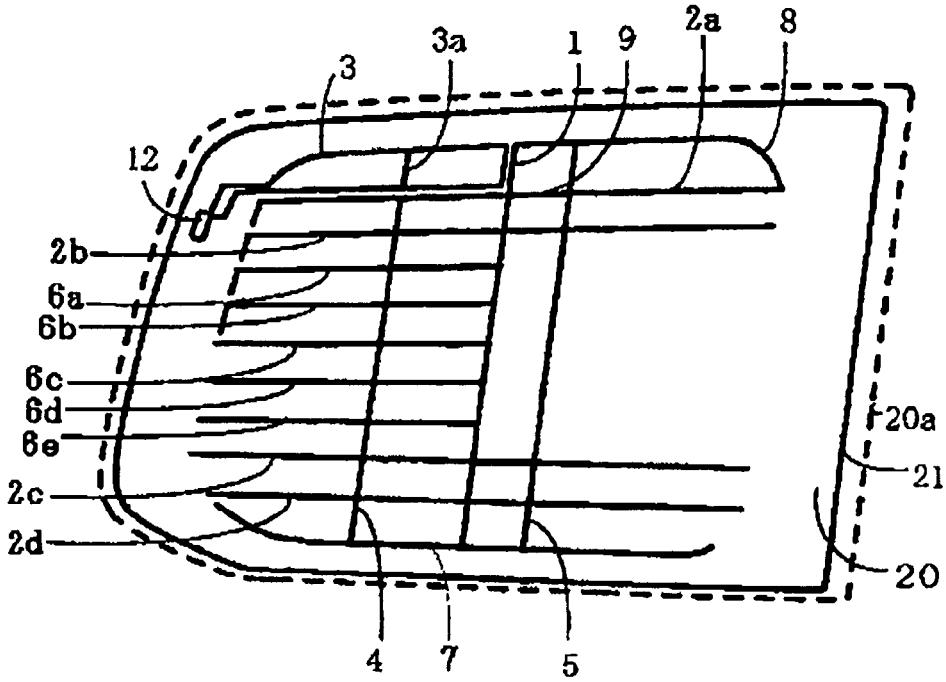
FIG. 1 is a front view showing a first embodiment of an automobile side window glass antenna of the present invention.

1: First antenna element
2*a* to 2*e*: Second antenna element
3: H-band antenna conductor
3*a*: Short circuit antenna element
4: First vertical auxiliary antenna element
5: Second vertical auxiliary antenna element
6: Transverse auxiliary antenna element
7: Lowermost transverse auxiliary antenna element
8: Uppermost transverse auxiliary antenna element
10: Third antenna element
11: L-band feeding portion
12: H-band feeding portion
13: Loop-forming element
20: Side window glass sheet
21: Automobile body opening edge of window

BEST MODE FOR CARRYING OUT THE INVENTION

Now, the automobile side window glass antenna of the present invention will be described in detail with reference to suitable embodiments shown in the attached drawings. FIG. 1 is a front view (view from the car-interior side or view from the car-exterior side) showing a first embodiment of the automobile side window glass antenna of the present invention.

In FIG. 1, numeral 1 represents a first antenna element, numerals 2*a* to 2*d* represent second antenna elements, a numeral 3 represents an H-band antenna conductor which receives electric waves of high frequency band, a numeral 3*a* represents a short circuit antenna element, a numeral 4 represents a first vertical auxiliary antenna element, a numeral 5 represents a second vertical auxiliary antenna element, and numerals 6*a* to 6*e* represent transverse auxiliary antenna elements.

Further, a numeral 7 represents a lowermost transverse auxiliary antenna element, a numeral 8 represents an uppermost transverse auxiliary antenna element, a numeral 9 represents a cross point of the first antenna element 1 and the second antenna element 2*a*, a numeral 12 represents an H-band feeding portion, a numeral 20 represents a side window glass sheet, a numeral 20*a* represents a periphery of the side window glass sheet, and a numeral 21 represents an automobile body opening edge of the window. In FIG. 1, the directions are defined as directions in the drawing, observed from the car-interior side or the car-exterior side. Further, in the following explanations, the term "antenna element" may be abbreviated to simply "element". Further, in the present invention, "high frequency band (H band)" means from 76 to 108 MHz, and "low frequency band (L band)" means from 520 to 1,700 KHz.

In the present invention, the H-band antenna conductor 3 for high frequency broadcasting and the H-band feeding portion 12 are provided in or on the side window glass sheet 20, and the H-band feeding portion 12 is provided in the vicinity of the automobile body opening edge 21 of the window. Here, the automobile body opening edge 21 of the window is the edge of an opening of an automobile body to which the side window glass sheet 20 is to be mounted, which functions also as an automobile body earth, and which is made of a conductive material such as a metal. The H-band antenna conductor 3 is usable so long as it has at least one element selected from the group consisting of a linear element, a curved element and a loop-forming element. Further, the H-band antenna conductor 3 preferably has a portion extending in the transverse direction or substantially in the transverse direction for the purpose of improving the antenna gain of horizontally polarized waves.

In the example shown in FIG. 1, the H-band antenna conductor 3 has a loop-shaped conductor, or the H-band antenna conductor 3 and the H-band feeding portion 12 constitute a loop-shaped portion, and such an embodiment is preferred. This is because such a loop-shaped conductor or the loop-shaped portion can expand the receiving band as compared with e.g. a linear element.

In the present invention, besides the H-band antenna conductor 3, an independent conductor, that is not connected with the feeding portion 12 in terms of direct current, is provided in or on the side window glass sheet 20. The independent conductor has a first element 1 extending in a vertical direction or substantially in a vertical direction, and a plurality of second elements 2*a* to 2*d* extending in the transverse direction or substantially in the transverse direction. The first element 1 and these second elements constitute a cross shaped or a substantially cross shaped element. However, they may form a T-shape, a substantially T-shape, a reversed T-shape or a substantially reversed T-shape.

Namely, the first antenna element extends vertically across the second antenna elements 2*a* to 2*d* so as to be connected with each of the second antenna elements 2*a* to 2*d* in the vicinity of the center in the left-right direction of the side window glass sheet 20. The first element 1 has a function of improving the antenna gain of vertically polarized waves in the high frequency band. The second elements 2*a* to 2*d* have a function of improving the antenna gain of horizontally polarized waves in the high frequency band. Further, by providing the first element 1 in the vicinity of the center in the left-right direction of the side window glass sheet 20, the antenna gain can be improved.

Both the first element 1 and the second element 2*a* are preferably capacitively coupled with the H-band antenna conductor 3. However, the construction is not limited thereto, and the construction may be such that at least one of the first element 1 and the second element 2*a* is capacitively coupled with the H-band antenna conductor 3. By such capacitive coupling, a received signal in the high frequency band excited by the independent conductor is propagated to the antenna conductor 3, whereby the antenna gain is improved.

In the example shown in FIG. 1, at least a half of the portion of the second element 2*a* provided on the left side of the cross point 9, is capacitively coupled with the H-band antenna conductor 3. However, the construction is not limited thereto, and a part or the entire part of the second element 2*a* provided on the left side of the cross point 9 may be capacitively coupled with the H-band antenna conductor 3. Further, it is sufficient that the H-band antenna conductor is formed outside the independent conductor, and is capacitively coupled with at least a part of antenna elements forming the outline of the independent conductor.

In the example shown in FIG. 1, when the side window glass sheet 20 is divided into four regions that are an upper left region, an upper right region, a lower right region and a lower left region by the first element and the second element 2*a* crossing at the cross point 9, at least the main part of the antenna conductor 3 is provided in the upper left region.

In the example shown in FIG. 1, the loop-shaped conductor or the loop-shaped portion has a loop shape extending in the transverse direction or substantially in the transverse direction. Further, in the present invention, when the glass antenna is observed from the car-interior side or the car-exterior side, the H-band feeding portion 12 is preferably provided in any one of the two regions that are the upper left region and the lower left region, for the purpose of improving the antenna gain. In this case, the left side portion of the H-band antenna conductor 3 is preferably connected with the H-band feeding portion 12, and the H-band antenna conductor 3 preferably extends from the feeding portion 12 towards the uppermost portion of the first element 1, for the purpose of improving the antenna gain.

In the example shown in FIG. 1, a portion of the H-band antenna conductor 3 opposite to the H-band feeding portion 12, is in proximity with the uppermost portion or the vicinity of the uppermost portion of the first element 1 that they are capacitively coupled. Employment of such an embodiment is preferred for improving the antenna gain. Further, it is sufficient that the H-band antenna conductor 3 has an extension portion extending upwardly along the outline of the independent conductor from the H-band feeding portion 12, and that this extension portion is capacitively coupled with the independent conductor. This extension portion is preferably capacitively coupled with element(s) provided in the upper portion of the independent conductor, in order to improve the antenna gain.

In the present invention, provided that the wavelength at the central frequency in the high frequency wave band in the air is $\lambda_0$, the shortening coefficient of wavelength by glass is k, the formula of k=0.64 is established, the formula of $\lambda_g=\lambda_0 \cdot k$ is established, and a portion wherein the H-band antenna conductor 3 is capacitively coupled with the independent conductor is designated as a capacitive coupling portion, then, the length of the capacitive coupling portion is preferably from $0.05 \cdot \lambda_g$ to $0.2 \cdot \lambda_g$, for the purpose of improving the antenna gain. The rage is more preferably from $0.07 \cdot \lambda_g$ to $0.2 \cdot \lambda_g$, particularly preferably from $0.1 \cdot \lambda_g$ to $0.2 \cdot \lambda_g$.

In the present invention, the conductor length of the second antenna element from the first antenna element to the vicinity of the H-band feeding portion is preferably from $(1/11)\lambda_g$ to $(1/4)\lambda_g$ for the purpose of improving the antenna gain in the high frequency band. The range is more preferably from $(1/10)\lambda_g$ to $(1/5)\lambda_g$, particularly preferably from $(1/9)\lambda_g$ to $(1/6)\lambda_g$.

In the example shown in FIG. 1, a first vertical auxiliary element 4, which extends in parallel or substantially in parallel with the first element 1 is provided between the first element 1 and the H-band feeding portion 12. The first vertical auxiliary element 4 extends across the second elements 2*a* to 2*d* so as to be connected with each of the second elements 2*a* to 2*d*. Such a construction is preferred for the purpose of improving the antenna gain and securing the field of view. However, the construction is not limited thereto, and the number of the first vertical auxiliary elements provided between the first element 1 and the H-band feeding portion 12 may be plural. Here, the first vertical auxiliary element is provided as the case requires.

When a plurality of the first vertical auxiliary elements is provided, at least one of the plurality of first vertical auxiliary elements is preferably connected with the second element 2*a* in the vicinity of the H-band feeding portion 12, in order to improve the antenna gain. The first vertical auxiliary element provided between the first element 1 and the H-band feeding portion 12 has a function of facilitating receiving of vertically polarized waves in the high frequency band to improve the antenna gain in the medium to high regions in the high frequency band.

In the example shown in FIG. 1, in a region of the side window glass sheet 20 opposite to the H-band feeding portion 12 across the first element 1, a second vertical auxiliary element 5 is provided, which extends in parallel or substantially in parallel with the first element 1. The second vertical auxiliary element 5 extends across the second elements 2*a* to 2*d* so as to be connected with each of the second elements 2*a* to 2*d*. Such an embodiment is preferred for the purpose of improving the antenna gain and securing the view field. However, the embodiment is not limited thereto, and the number of the second vertical auxiliary elements provided in a region of the side window glass sheet 20 opposite to the H-band feeding portion 12 across the first element 1 may be plural.

When a plurality of the second vertical auxiliary elements is provided, at least one of the plurality of second vertical auxiliary elements is preferably connected with the second element 2*a* of the uppermost position in order to improve the antenna gain. The second vertical auxiliary elements provided in the region of the side window glass sheet 20 opposite to the feeding portion 12 across the first element 1, have a function of facilitating receiving of vertically polarized waves in the high frequency region, and improving the antenna gain in the upper low region to the high region (88 to 108 MHz) in the high frequency band. Here, the second vertical auxiliary element is provided as the case requires.

The distance between the first element 1 and the second vertical auxiliary element 5 (when a plurality of second vertical auxiliary elements is provided, this applies also to the distance between adjacent second vertical auxiliary elements) is preferably from $0.074\cdot(\lambda_g/4)$ to $0.138\cdot(\lambda_g/4)$ for the purpose of improving the antenna gain in the upper low region to the high region in the high frequency band. The range is more preferably from $0.085\cdot(\lambda_g/4)$ to $0.127\cdot(\lambda_g/4)$, particularly preferably from $0.096\cdot(\lambda_g/4)$ to $0.117\cdot(\lambda_g/4)$.

In the example shown in FIG. 1, between the second elements 2*b* and 2*c*, a plurality of transverse auxiliary elements 6*a* to 6*e* are provided, which extend to the first element 1 from the vicinity of the edge of the side window glass sheet 20 on a side in which the H-band feeding portion 12 is provided, so as to be in parallel or substantially in parallel with the second elements. Employment of such an embodiment is preferred for the purpose of improving the antenna gain in the high frequency band. However, the embodiment is not limited thereto, and it is sufficient that between the second elements 2*b* and 2*c*, at least one transverse auxiliary element is provided so as to be in parallel or substantially with the second element 2*a*. Further, it is sufficient that one or a plurality of transverse auxiliary elements are provided, which extend to be connected with the first vertical auxiliary element 4, without being connected with the first element 1, from the vicinity of the edge of the side window glass sheet in which the H-band feeding portion 12 is provided. Each of the transverse auxiliary elements has a function of improving the antenna gain of horizontally polarized waves in the mid-high region (76 to 108 MHz) in the high frequency band.

In the example shown in FIG. 1, the second elements 2*a* to 2*d* extend into the other side across the first element 1 from the side in which the H-band feeding portion 12 is provided, and the second elements 2*a* and 2*d* are further connected with the second vertical auxiliary element 5 and extend across the element 5. On the other hand, the transverse auxiliary elements 6*a* to 6*e* do not extend across the first element 1 from the side on which the H-band feeding portion 12 is provided. Further, the second elements 2*a* to 2*d* are provided in the vicinities of the upper end and the lower end other than the vicinity of the center in the vertical direction of the side window glass sheet.

Employment of such an embodiment is preferred for the purpose of improving the antenna gain in the high frequency band and for securing the field of view. Namely, since the transverse auxiliary elements do not extend across the first element 1, no element is present in the vicinity of the center in the vertical direction in an area opposite to the side on which the H-band feeding portion 12 is provided, across the first element 1, and such an embodiment is preferred for the purpose of securing the appearance and the field of view.

In the example shown in FIG. 1, each of the second elements 2*a*, 2*b* and the transverse auxiliary elements 6*a*, 6*b* has a portion in the vicinity of a left side open end turning downwardly so as to be capacitively coupled with the adjacent lower element. Employment of such an embodiment is preferred for the purpose of improving the antenna gain in the low region in the high frequency band. The minimum distance between the open end and the second element or the transverse auxiliary element is preferably from 2 to 10 mm, particularly preferably from 3 to 7 mm for the purpose of capacitive coupling.

When the H-band antenna conductor is a loop-shaped conductor, the total length of the conductor length to the turning point of the loop-shape and the length of an AV line (not shown), that is connected with the H-band feeding portion, is preferably from $(1/8)\lambda_g$ to $(1/2)\lambda_g$ for the purpose of improving the antenna gain. This is because the conductor length to the turning point of the loop-shaped conductor (the maximum transverse size if a rectangular loop-shaped conductor has a long side in the horizontal direction) functions as a resonance factor in the high frequency band. The range is more preferably from $(1/8)\lambda_g$ to $(1/3)\lambda_g$, particularly preferably from $(1/8)\lambda_g$ to $(1/4)\lambda_g$.

In the example of FIG. 1, the antenna conductor 3 is provided with a short circuit element 3*a*, which is provided as the case requires, so that the loop-shaped conductor or the loop-shaped portion is divided by the short circuit element 3*a*. Since the loop-shaped conductor or the loop-shaped portion is divided by the short circuit element 3*a*, a plurality of resonances are generated. Accordingly, the short circuit element 3*a* has a function of expanding the band, whereby the antenna gain in the high frequency band becomes flat.

In the example of FIG. 1, a lowermost transverse auxiliary element 7 is provided. The lowermost transverse auxiliary element 7 is connected with the lowermost portion of the first element 1, the lowermost portion of the first vertical auxiliary element 4 and the lowermost portion of the second vertical auxiliary element 5, and extends in the left-right direction along the lower end shape of the transparent portion of the side window glass sheet 20. However, the construction is not limited thereto, and the lowermost transverse auxiliary element 7 may be connected with either one or both of left and right side ends of the second element 2*d*. Here, the lowermost transverse auxiliary element 7 is provided as the case requires.

In the example shown in FIG. 1, an uppermost transverse auxiliary element 8 is provided. The uppermost transverse auxiliary element 8 is connected with the uppermost portion of the first element 1, the uppermost portion of the second vertical auxiliary element 5 and the end portion of the second element 2*a* on the opposite side to the H-band feeding portion 12. However, the construction is not limited thereto, and the uppermost transverse auxiliary element 8 may be connected with any one of the first element 1 and the second element 2*a*. Here, the uppermost transverse auxiliary element 8 is provided as the case requires.

Figure 2:
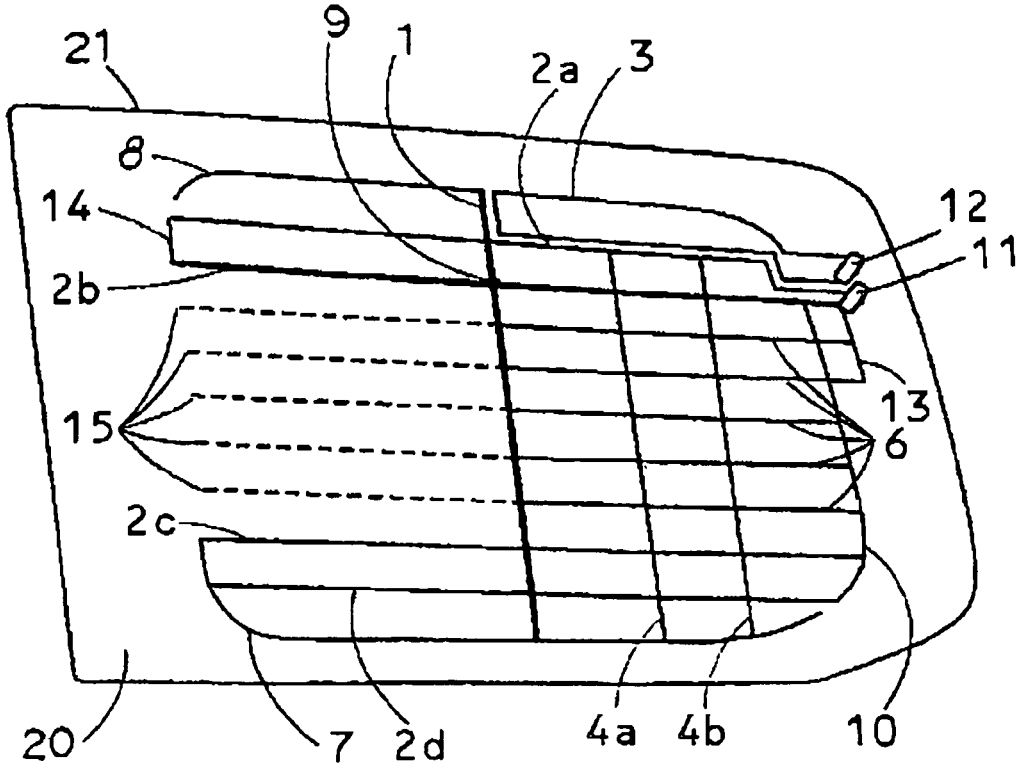
FIG. 2 is a front view showing a second embodiment of the automobile side window glass antenna of the present invention.

Next, a second embodiment of the present invention will be described. FIG. 2 is a front view showing an embodiment of the automobile side window glass antenna of the present invention.

In FIG. 2, a numeral 1 represents a first antenna element, numerals 2*a* to 2*d* represent second antenna elements, a numeral 3 represents an H-band antenna conductor, numerals 4*a*, 4*b* represent first vertical auxiliary antenna elements, a numeral 6 represents a transverse auxiliary antenna element, a numeral 7 represents a lowermost transverse auxiliary element, a numeral 8 represents an uppermost transverse auxiliary element, a numeral 9 represents a cross point of the first antenna element 1 and the second antenna element 2*b*, a numeral 10 represents a third antenna element, a numeral 11 represents an L-band feeding portion, a numeral 12 represents an H-band feeding portion, a numeral 13 represents a loop-forming element, a numeral 14 represents a fourth antenna element, a numeral 15 represents an extension portion of the transverse auxiliary antenna element, a numeral 20 represents a side window glass sheet and a numeral 21 represents an automobile body opening edge of window.

In FIG. 2, the directions are defined as the direction in the drawing. Further, the portions common to those in FIG. 1 are represented by the same numerals, and explanation of these portions may be omitted. The antenna elements connected with the L-band feeding point 11 are each a part of the L-band antenna conductor.

The example shown in FIG. 2 is an example observed from the car-interior side or the car-exterior side, and in FIG. 2, the L-band feeding portion 11, that is for the low frequency band particularly for the AM broadcast band, and the H-band feeding portion 12 that is for the high frequency band having a higher frequency than the AM broadcast band, are provided in proximity to each other in the vicinity of the automobile body opening edge 21 of the window, on the automobile side window glass sheet 20. An L-band antenna conductor for the AM broadcast band is connected to the L-band feeding portion, and the H-band antenna conductor 3 for the high frequency band is connected to the L-band feeding portion 12.

Further, the L-band feeding portion 11 and the H-band feeding portion 12 are provided in the vicinity of the upper right edge of the automobile body opening edge 21 of the window. Employment of such an embodiment is preferred for the purpose of improving the antenna gain in the high frequency band. However, the embodiment is not limited thereto, and so long as the L-band feeding portion 11 and the H-band feeding portion 12 are in proximity to each other and they are provided in the vicinity of the right side edge of the automobile window opening edge 21 of the window when they are observed from the car-interior side or the car-exterior side, these feeding portions are usable. In the example shown in FIG. 2, the right side edge is provided along the vertical direction or substantially along the vertical direction.

The L-band antenna conductor has a first element 1 extending in the vertical direction or substantially in the vertical direction and a plurality of second elements 2*a* to 2*d* extending in the transverse direction or substantially in the transverse direction. The first element 1 and the second elements 2*a* to 2*d* constitute a cross shaped or a substantially cross shaped element. The construction is not limited thereto, and they may constitute a T shape, a substantially T shape, a reversed T shape or a substantially reversed T shape.

Right side ends of the second elements 2*a* and 2*b* are connected with the L-band feeding portion 11. In the example shown in FIG. 2, the H-band antenna conductor 3 and the H-band feeding portion 12 constitute a loop-shaped portion, and employment of such an embodiment is preferred for the purpose of extending the band in the high frequency band. However, the embodiment is not limited thereto, and it is sufficient that the H-band antenna conductor 3 has a loop-shaped conductor. Further, the L-band antenna conductor has a function of independent conductor shown in FIG. 1, that is independent from the H-band antenna conductor 3.

The H-band antenna conductor 3 extends from the H-band feeding portion 12 towards the uppermost portion of the first element 1, and a portion of the H-band antenna conductor 3 opposite to the H-band feeding portion 12 is provided in proximity with at least one of the uppermost portion and the vicinity portion thereof of the first element 1 to be capacitively coupled.

Further, the construction is not limited thereto, and in the example shown in FIG. 2, the second element 2*a*, that is connected with the L-band feeding portion 11, and the H-band antenna conductor 3 are provided in proximity to each other to be capacitively coupled. It is sufficient that the H-band antenna conductor 3 is capacitively coupled with at least one of the first element 1 and the second element 2. That is, so long as the H-band antenna conductor 3 is capacitively coupled with an element of the H-band antenna conductor, the antenna is usable. Employment of such an embodiment is preferred for the purpose of improving the antenna gain.

In the example shown in FIG. 2, the H-band feeding portion 12 is provided above the L-band feeding portion 11, and employment of such an embodiment is preferred for the purpose of improving the antenna gain in the high frequency band. However, the embodiment is not limited thereto, and even if the H-band feeding portion 12 is provided below the L-band feeding portion 11, the antenna is usable.

The minimum distance between the L-band feeding portion 11 and the H-band feeding portion 12 is preferably from 3 to 50 mm. When the minimum distance is at least 3 mm, as compared with a case where it is less than 3 mm, the antenna gain in the high frequency band can be improved, such being preferred. When the minimum distance is at most 50 mm, as compared with a case where it exceeds 50 mm, convenience of mounting the antenna is improved, such being preferred. The range is more preferably from 3 to 40 mm, particularly preferably from 3 to 30 mm.

In the example shown in FIG. 2, a third element 10 is provided, which extends downwardly from the second element 2*b* in the vicinity of the L-band feeding portion 11 along the shape of the transparent portion of the side window glass sheet 20. It is also possible to provide the third element 10 so as to start from the L-band feeding portion 11. The third element 10 is connected with the second element 2*d* provided in the lower portion of the side window glass sheet 20. However, the construction is not limited thereto, and it is sufficient that the third element 10 extends in the vertical direction or substantially in the vertical direction so as to connect at least two of the ends or their vicinities on the H-band feeding portion side of the second elements 2*a* and 2*b*, and the end or its vicinity on the H-band feeding portion side of the transverse auxiliary antenna element 6.

Further, as in the first embodiment shown in FIG. 1, the third element 10 may have a discontinuous portion at least one of adjacent connections in the at least two connections with the ends or their vicinities on the H-band feeding portion side of the end of the second elements 2*a* and 2*b*, and the end or its vicinity on the H-band feeding portion side of the transverse auxiliary antenna element 6.

Further, a lowermost transverse auxiliary element 7 is provided, which is connected with the lower end of the first element 1 and extends in the left-right direction along the shape of the transparent portion of the side window glass sheet 20. The lowermost transverse auxiliary element 7 extends in the left direction along the shape of the transparent portion of the side window glass sheet 20, and extends upwardly to be connected with the end or the end vicinity portion on the left side of the second elements 2*c* and 2*d*. The left end of the lowermost transverse auxiliary element 7 is provided so as not to be connected with the third element 10. The lowermost transverse auxiliary element 7 has a function of improving the antenna gain in the AM broadcast band (520 to 1,700 KHz) and the high frequency band. The open end on the right side of the lowermost transverse auxiliary element 7 is preferably capacitively coupled with the third element 10 for the purpose of improving the antenna gain in the high region of the high frequency band. The minimum distance between the open end and the third element 10 is preferably from 2 to 20 mm to improve the antenna gain in the high frequency band. The range is more preferably from 2 to 10 mm, particularly preferably from 2 to 5 mm.

In the example shown in FIG. 2, between the first element 1 and the L-band feeding portion 11, two first vertical auxiliary elements 4*a* and 4*b* extending in parallel or substantially in parallel with the first element 1, are provided.

The first vertical auxiliary elements 4*a* and 4*b* are provided as the case requires, and they have a function of improving the antenna gain in the AM broadcast band and the high frequency band. The first vertical auxiliary elements 4*a* and 4*b* are connected with the second elements 2*a* and 2*b* and the lowermost transverse auxiliary element 7. Employment of such an embodiment is preferred for the purpose of improving antenna gain in the high frequency band. However, the embodiment is not limited thereto, and the glass antenna can be used even if the first vertical auxiliary elements 4*a* and 4*b* are not connected with any one of the second elements and the lowermost transverse auxiliary element.

When the first vertical auxiliary element(s) is provided, the number of the element(s) may be single or plural, but the number of the first vertical auxiliary element(s) is preferably from one to five, particularly preferably from two to three.

When the number of the first vertical auxiliary elements is at most five, the visibility is better as compared with a case where the number exceeds five. Further, a second vertical auxiliary element may be provided on the left side of the first element 1.

In the present invention, as the case requires, a single or a plurality of transverse auxiliary elements 6 extending in parallel or substantially in parallel with the second element, are preferably provided on the side window glass sheet 20, for the purpose of improving the antenna gain in the AM broadcast band.

When the transverse auxiliary elements 6 are provided, the number of the transverse auxiliary elements 6 is preferably from two to eight, particularly preferably from three to seven. In the example shown in FIG. 2, the number of the transverse auxiliary elements 6 is five, and all of the five transverse auxiliary elements 6 are connected with the first element 1, the third element 10 and the vertical auxiliary elements 4*a* and 4*b*.

As shown in the broken lines (extension portions 15 of the transverse auxiliary elements 6) in FIG. 2, when the transverse auxiliary elements 6 extend toward the left side edge of the automobile body opening edge 21 of the window, the antenna gain in the AM broadcast band can be improved. The extension portions 15 are elements provided as the case requires.

In the example shown in FIG. 2, a fourth element 14 connecting the second elements 2*a* and 2*b* is provided on the side window glass sheet 20. The fourth element 14 is an element to be provided as the case requires, and it is provided so as to to connect with the left side ends or the vicinities of the left side ends of the second elements 2*a* and 2*b*. By connecting the second elements 2*a* and 2*b*, the antenna gain in the high frequency band improves as compared with a case where these elements are not connected.

In the example shown in FIG. 2, at the uppermost portion of the first element 1, an uppermost transverse auxiliary element 8 having a J shape or a substantially J shape is provided along the shape of the transparent portion of the side window glass sheet 20. The uppermost transverse auxiliary element 8 has a function of improving the antenna gain in the AM broadcast band and the high frequency band. The uppermost transverse auxiliary element 8 extends from the uppermost portion of the first element 1 towards the left side edge of the automobile body opening edge 21 of the window. The open end of the uppermost transverse auxiliary element 8 is provided in the vicinity of the second element 2*a*. Thus, when the open end of the uppermost transverse auxiliary element 8 is not connected with the second element 2*a*, the antenna gain in the high frequency band improves as compared with a case where they are connected.

In the example shown in FIG. 2, a loop-forming element 13, that is to be provided as the case requires, is provided. The loop-forming element 13 has a function of improving the antenna gain in a high region in the high frequency band. The loop-forming element 13 has a left-right-reversed L shape or a substantially left-right-reversed L shape, and the upper end of the loop-forming element 13 is connected with the L-band feeding portion 11 or the second element 2*b*. The lower end of the loop-forming element 13 is connected with the third element 10. Accordingly, the third element 10 and the loop-forming element 13 constitute a loop along with at least one of the second element 2*b* and the L-band feeding portion 11.

In the example shown in FIG. 2, among the transverse auxiliary elements 6, the element in the uppermost position extends towards the right side, and is connected with the loop-forming element 13. Thus, when the transverse auxiliary element 6 is connected with the loop-forming element 13, the antenna gain in the high region in the high frequency band improves as compared with a case where they are not connected.

Figure 3:
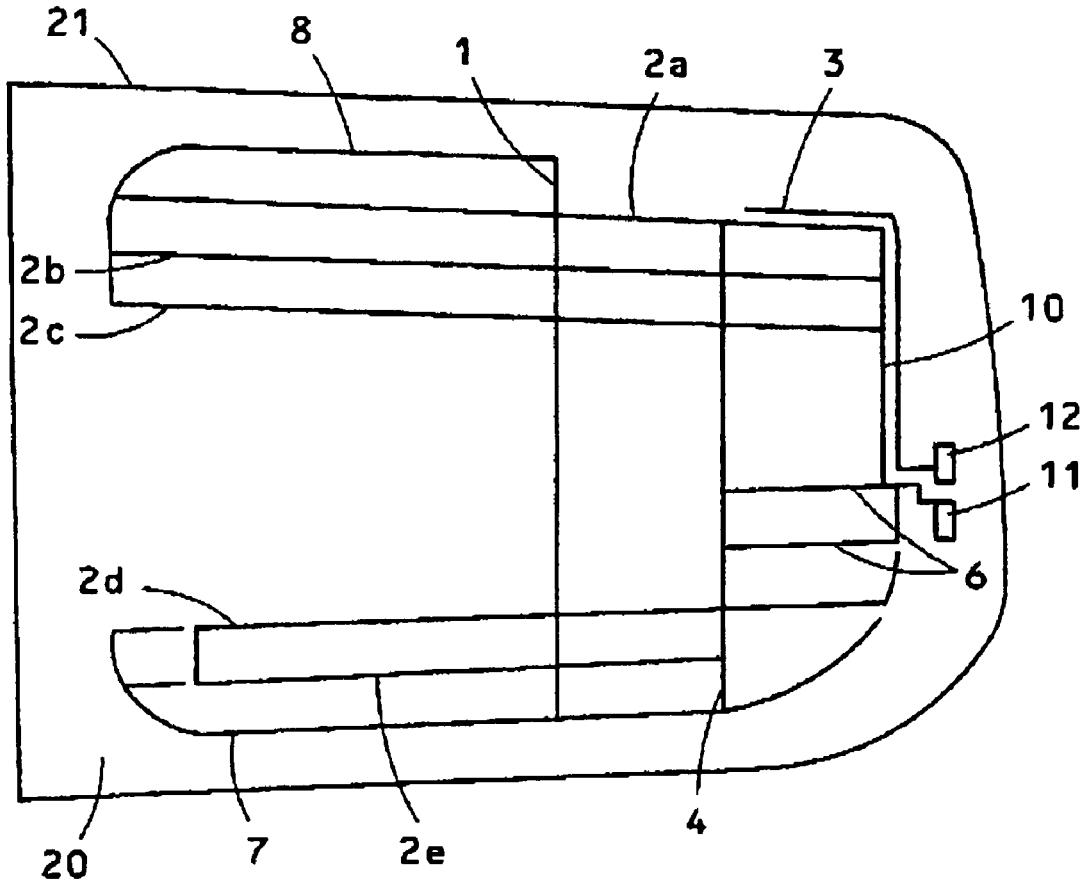
FIG. 3 is a front view showing a third embodiment of the automobile side window glass antenna of the present invention.

Next, a third embodiment of the present invention will be described. FIG. 3 is a front view showing an embodiment of the automobile side window glass antenna of the present invention.

In FIG. 3, a numeral 1 represents a first antenna element, numerals 2*a* to 2*e* represent second antenna elements, a numeral 3 represents an H-band antenna conductor, a numeral 4 represents a first vertical auxiliary antenna element, a numeral 6 represents transverse auxiliary antenna elements, a numeral 7 represents a lowermost transverse auxiliary antenna element, a numeral 8 represents an uppermost transverse auxiliary antenna element, a numeral 10 represents a third antenna element, a numeral 11 represents an L-band feeding portion, a numeral 12 represents an H-band feeding portion, a numeral 20 represents a side window glass sheet, and a numeral 21 represents an automobile body opening edge of a window.

In FIG. 3, the directions are defined as directions in the drawing. Further, portions common to those of FIG. 2 are represented by the same numerals, and explanations of these portions are omitted. The example shown in FIG. 3 is an example observed from the car-interior side or the car-exterior side.

In FIG. 3, the L-band feeding portion 11 and the H-band feeding portion 12 are provided on the automobile side window glass sheet in the vicinity of the automobile opening edge 21 of the window so that the L-band feeding portion 11 is connected with the third element 10 and the H-band feeding portion 12 is in proximity to the L-band feeding portion 11.

The L-band antenna conductor has a first element extending in the vertical direction or substantially in the vertical direction, and a plurality of second elements 2*a* to 2*e* extending in the transverse direction or substantially in the transverse direction, and they cross each other to constitute a cross-shaped or a substantially cross-shaped element. The construction is not limited thereto, and they may constitute a T shape, a substantially T shape, a reversed T shape or a substantially reversed T shape.

The second element 2*e* extends, on the right side of the first element, only to the first vertical auxiliary element 4 provided between the first element 1 and the L-band feeding portion 11 in the left-right direction. Further, the second elements 2*d* and 2*e* extend, on the left side of the first element, only to the middle, as differently from other second elements 2*a*, 2*b* and 2*c*, and the ends of the second elements 2*d* and 2*e* are connected each other by a connecting conductor. Further, two transverse auxiliary conductors 6 are provided between the first vertical auxiliary element 4 and the third element 10, but they do not extend to the first element 1.

By thus adjusting the conductor lengths of the second element and the transverse auxiliary element, an antenna conductor usable in a wide band is achieved, which has various loop lengths of many loop shapes formed by providing vertically extending vertical elements such as the first element, the first vertical auxiliary element and the second vertical auxiliary element (not provided in FIG. 3) so as to intersect transversely extending transverse elements such as the second elements and the transverse auxiliary element.

In the example shown in FIG. 3, the lowermost transverse auxiliary element 7 has a left side end extending upwardly along the transparent portion of the side window glass sheet 20. Further, at the left side end or the vicinity of the left side end of the lowermost transverse auxiliary element 7, elements in parallel with the second elements 2*d* and 2*e* are provided. By these elements, a shape similar to the shape constituted by the uppermost auxiliary element 8 and the second elements 2*a*, 2*b* and 2*c*, is formed to improve the appearance.

In the example shown in FIG. 3, the third element 10 is provided so as to connect the right side ends or the vicinities of the right side ends of the second element and the transverse auxiliary element 6. Further, a discontinuous portion is provided at the end portion of a part of adjacent transverse auxiliary elements 6. Thus, in the present invention, the second element and the transverse auxiliary element 6 may be connected with each other, or a discontinuous portion may be provided in the third element 10 so that the second element or the transverse auxiliary element turns and extends, or these options may be combined.

Further, in the example of FIG. 3, the H-band antenna conductor 3 has a shape of 180°-rotated L shape, and is capacitively connected with the second element 2*a* and a part of the third element 10. The construction is not limited thereto, and it is sufficient that the H-band antenna conductor 3 is formed along the outline of elements constituting the L-band antenna conductor, and is capacitively connected with a part of the L-band antenna conductor.

Here, the total length of the conductor length of the H-band antenna conductor and the length of the AV line connected with the H-band feeding portion, is preferably from $(1/8)\lambda_g$ to $(1/2)\lambda_g$ for the purpose of improving the antenna gain.

In the first to third embodiments Shown in FIGS. 1 to 3, each of the antenna elements and feeding portions is usually formed by printing paste, such as silver paste, containing a conductive metal on a car-interior side surface of the side window glass sheet 20 and curing the printed paste. However, the forming method is not limited thereto, and a linear member or a foil-shaped member of a conductive material such as copper may be formed on the car-interior side surface or the car-exterior side surface of the side window glass sheet 20, or they may be embedded in the side window glass sheet 20 itself.

The present invention is not limited to the first to third embodiments shown in FIGS. 1 to 3, and may be configured so as to be capable of suitably receiving electric waves by combining the constituents of the embodiments. Further, for example, by applying the first embodiment and the second embodiment to the left and right automobile side window glass sheets, respectively, and carrying out diversity reception, reception sensitivity further improves, such being preferred.

EXAMPLES

Now, the present invention will be described with reference to Examples, but the present invention is not limited to these Examples, and various improvements and modifications are included in the scope of the present invention so long as they do not depart from the gist of the present invention. In the following, Examples will be described in detail with reference to drawings.

Example 1

Example of the Present Invention

Figure 4:
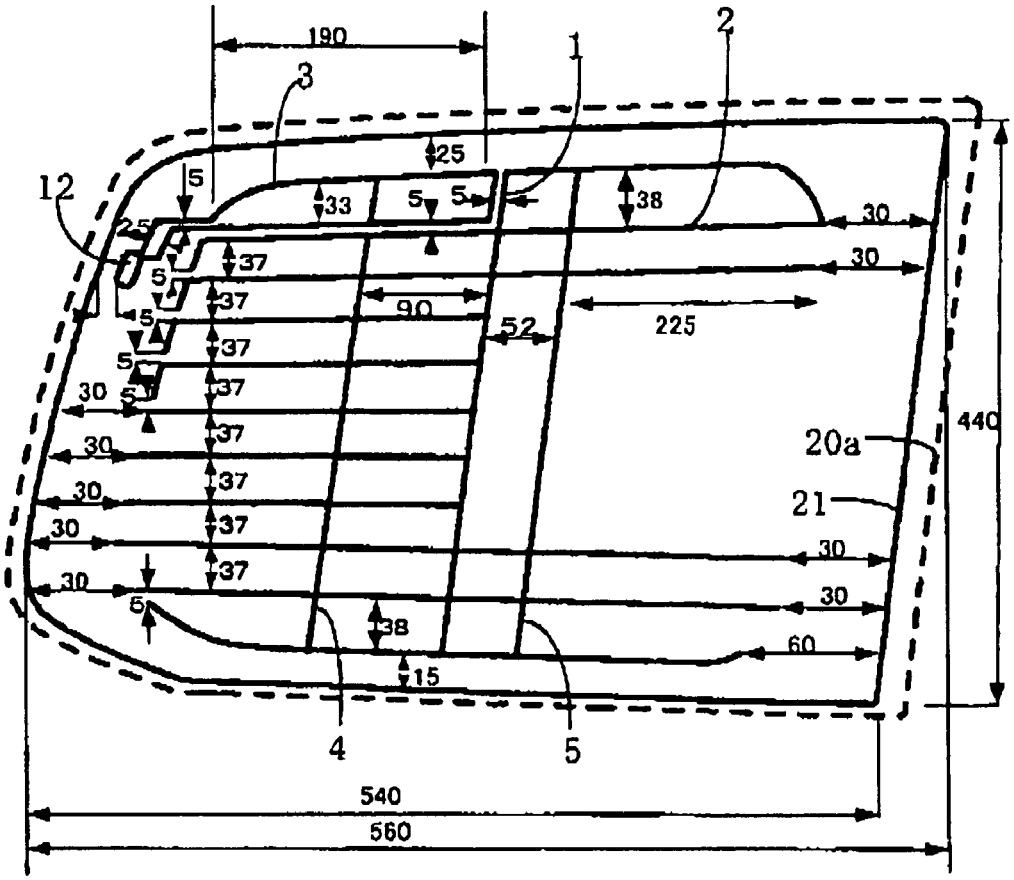
FIG. 4 is a front view showing dimensions of the automobile side window glass antenna of Example 1.
Figure 5:
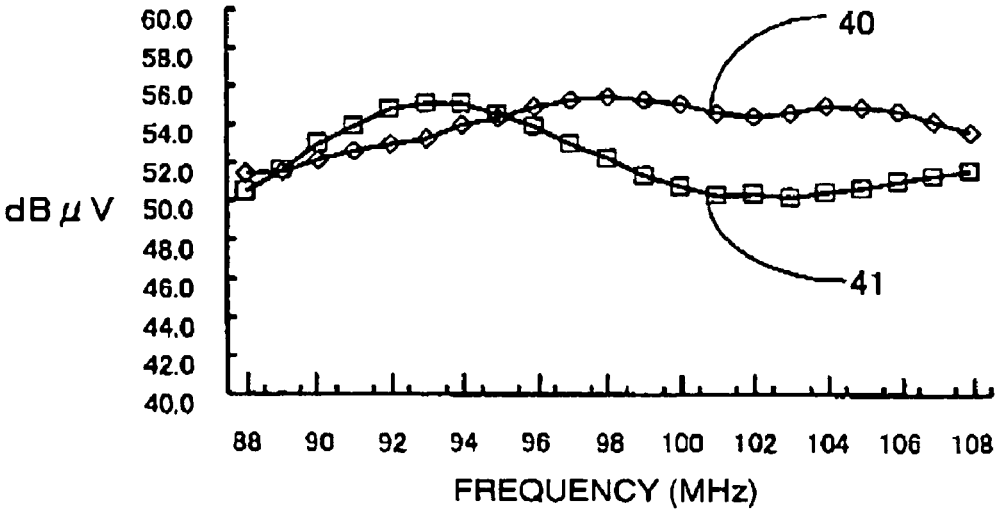
FIG. 5 is a view showing frequency vs. antenna gain characteristics of vertically polarized waves in Examples 1 and 5.
Figure 6:
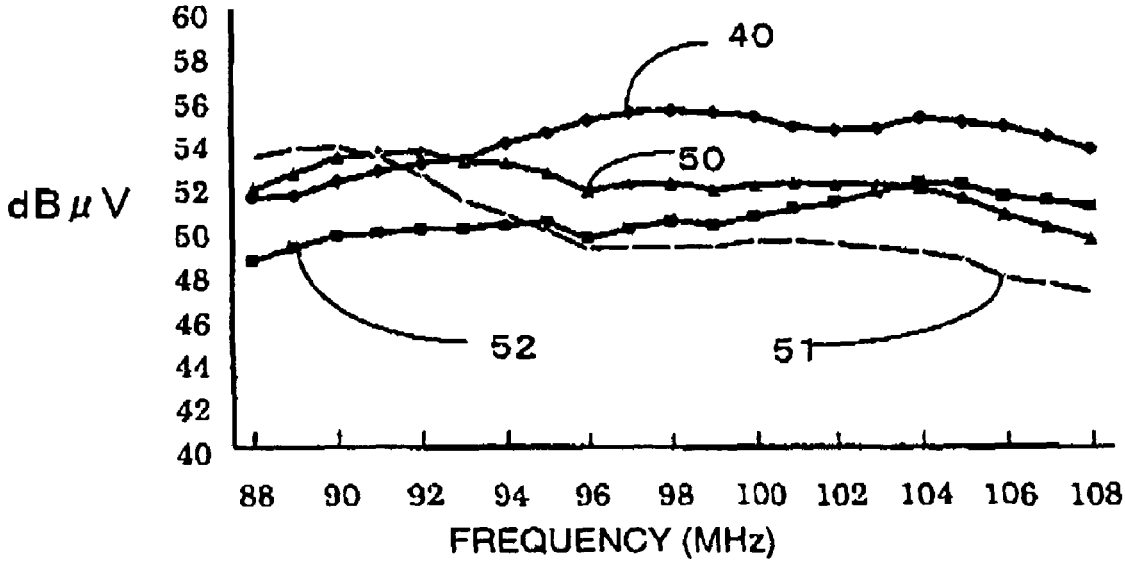
FIG. 6 is a view showing frequency vs. antenna gain characteristics of vertically polarized waves in Examples 2 to 4.

Using a rear-position side-window glass sheet on the left side of an automobile when it is observed from the rear side, which was mounted on an automobile body opening edge 21 of the rear-position side-window of the automobile, an automobile side window glass antenna as shown in FIG. 1 was produced. FIG. 4 shows dimensions of its portions. In FIG. 4, numerical figures in the vicinity of dimension lines represent dimensions, and their unit is mm. Here, dimensions not described in FIG. 4 are described below. The frequency vs. antenna gain characteristic of vertically polarized waves is represented by a curve 40 shown in FIG. 5 and a curve 40 shown in FIG. 6. The curve 40 in FIG. 5 and the curve 40 in FIG. 6 are the same curve.

Conductor width of H-band antenna conductor 3 and short circuit element 3*a:* 0.5 mm Dimensions of H-band feeding portion 12: 27 mm×12 mm Further, provided that $\lambda_g$=1.959 (central frequency 98 MHz), the following dimensions are read from FIG. 4.

Length of capacitive-coupling portion: 228 mm (=0.116·$\lambda_g$)

Conductor length of the second element from the first element 1 to the vicinity of the H-band feeding portion 12: 237 mm (=(⅛)$\lambda_g$)

Total length of conductor length of H-band antenna conductor 3 (loop-shaped conductor) to turning point of loop shape and the length of AV line connected to the H-band feeding portion 12: 400 mm (=(⅕)$\lambda_g$)

Example 2

Example of the Present Invention

An automobile side window glass antenna was produced, which was the same as the one of Example 1 except that the first vertical auxiliary element 4 was not provided. FIG. 6 shows the frequency vs. antenna gain characteristic of vertically polarized waves as a curve 50.

Example 3

Example of the Present Invention

An automobile side window glass antenna was produced, which was the same as the one of Example 1 except that the second vertical auxiliary element 5 was not provided. FIG. 6 shows the frequency vs. antenna gain characteristic of vertically polarized waves as a curve 51.

Example 4

Comparative Example

An automobile side window glass antenna was produced, which was the same as the one of Example 1 except that the first element 1 was not provided. FIG. 6 shows the frequency vs. antenna gain characteristic of vertically polarized waves as a curve 52.

Example 5

Comparative Example

Figure 10:
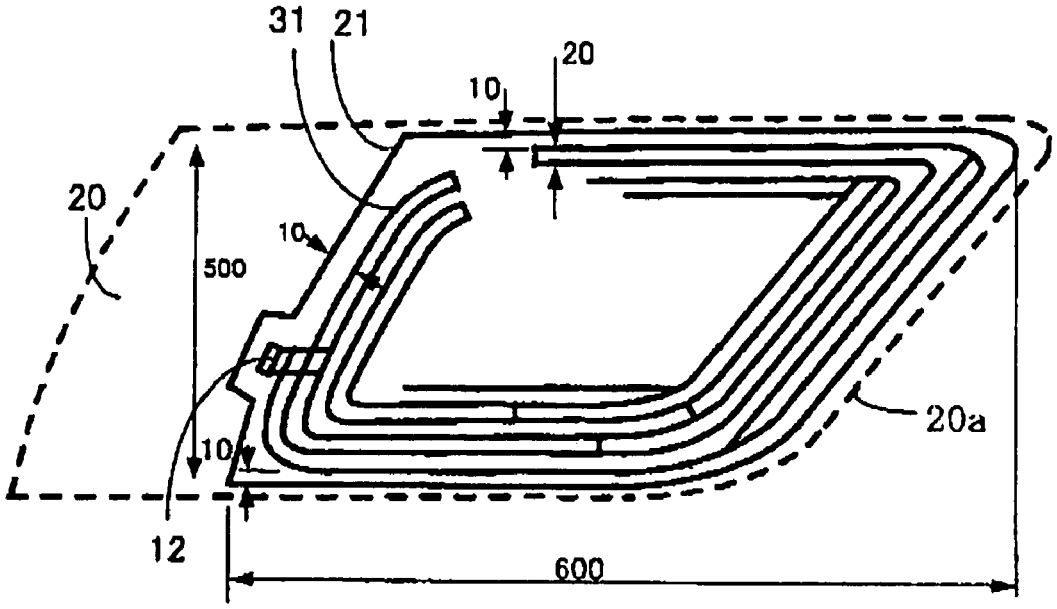
FIG. 10 is a front view showing an example of conventional glass antenna.

Using a left side rear-position side-window glass sheet, which was mounted on an automobile body opening edge 21 of the rear-position side-window of the automobile, an automobile side window glass antenna shown in FIG. 10 was produced. In FIG. 10, numerical figures in the vicinity of dimension lines represent dimensions, and their unit is mm. FIG. 5 shows the frequency vs. antenna gain characteristic of vertically polarized waves as a curve 41.

Example 6

Example of the Present Invention

Figure 7:
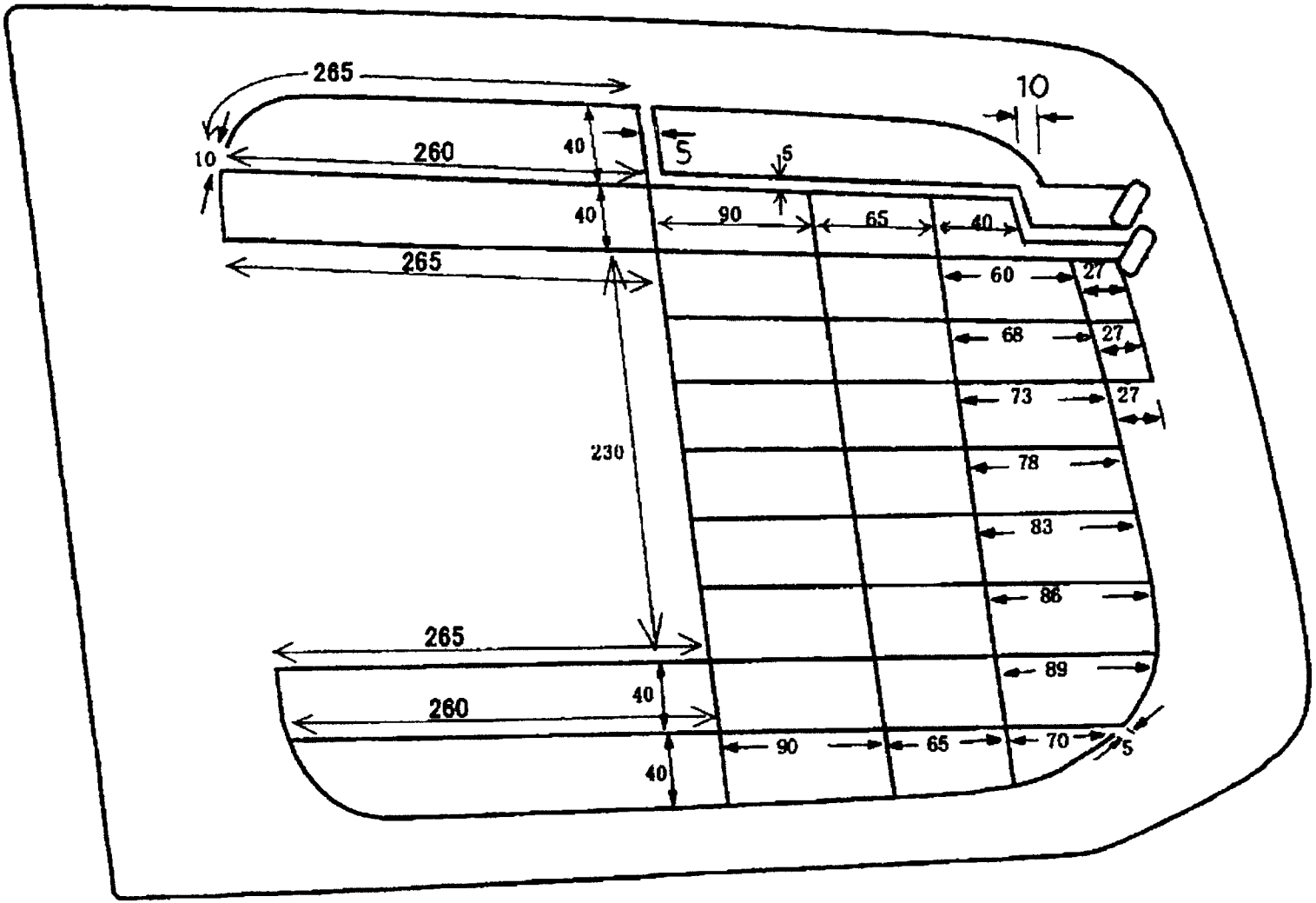
FIG. 7 is a front view showing dimensions of an automobile side window glass antenna of Example 6.
Figure 8:
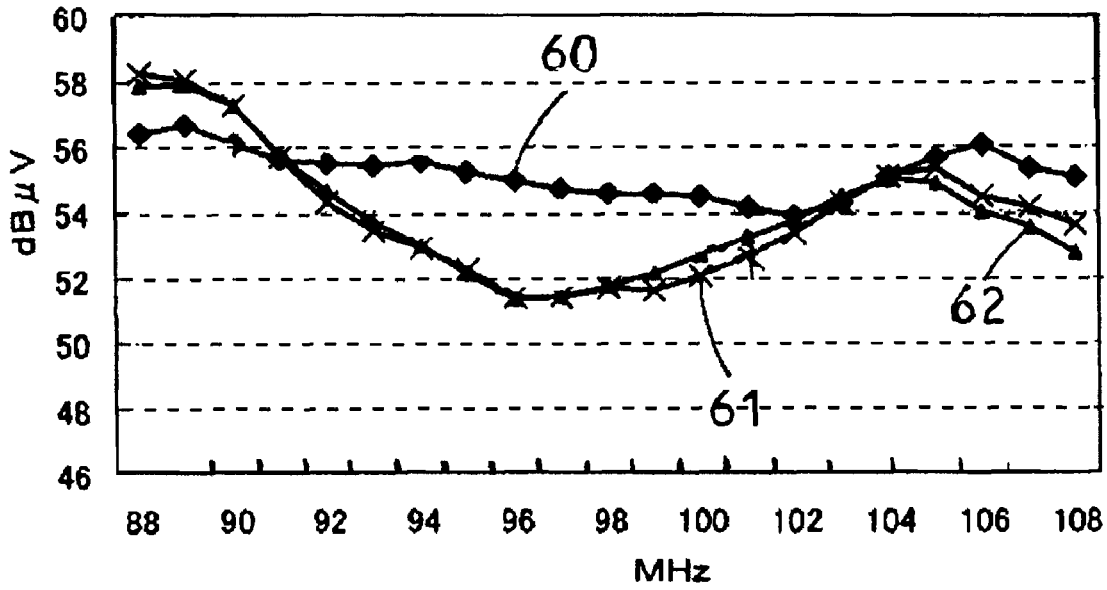
FIG. 8 is a view showing frequency vs. antenna gain characteristics of vertically polarized waves in Example 6 to 8.

Using a right side rear-position side-window glass sheet, which was mounted on an automobile body opening edge of the rear-position side-window of an automobile, an automobile high frequency glass antenna shown in FIG. 2 was produced. FIG. 7 shows dimensions of an L-band antenna conductor and an H-band antenna conductor 3. In FIG. 7, numerical figures represent dimensions, and their unit is mm. Here, dimensions not described in FIG. 7 are described below. No extension portion 15 of the transverse auxiliary element 6 was provided. FIG. 8 shows the frequency vs. antenna gain characteristic of vertically polarized waves as a curve 60.

Conductor width of L-band antenna conductor and H-band antenna conductor: 0.5 mm Minimum distance between L-band feeding portion 11 and H-band feeding portion 12: 15 mm Dimensions of L-band feeding portion 11 and H-band feeding portion 12: 27 mm×12 mm Further, provided that $\lambda_g$=1.959 (central frequency 98 MHz), the following dimensions are read from FIG. 7

Length of capacitive-coupling portion: 300 mm (=0.15·$\lambda_g$)

Conductor length of second element from first element 1 to the vicinity of H-band feeding portion 12: 270 mm (=(1/7)$\lambda_g$)

Total length of conductor length of H-band antenna conductor 3 (loop-shaped conductor) to turning point of loop shape and the length of AV line connected to H-band feeding portion 12: 400 mm (=(⅕)$\lambda_g$)

Example 7

Example of the Present Invention

An automobile high frequency glass antenna was produced, which was the same as the one of Example 6 except that no vertical auxiliary element 4*b* was provided (the vertical auxiliary element 10 was provided). FIG. 8 shows the frequency vs. antenna gain characteristic of vertically polarized waves as a curve 61.

Example 8

Example of the Present Invention

An automobile high frequency glass antenna was produced, which was the same as the one of Example 6 except that no vertical auxiliary element 4*a* was not provided (the vertical auxiliary element 4*b* was provided). FIG. 8 shows the frequency vs. antenna gain characteristic of vertically polarized waves as a curve 62.

Example 9

Comparative Example

Figure 9:
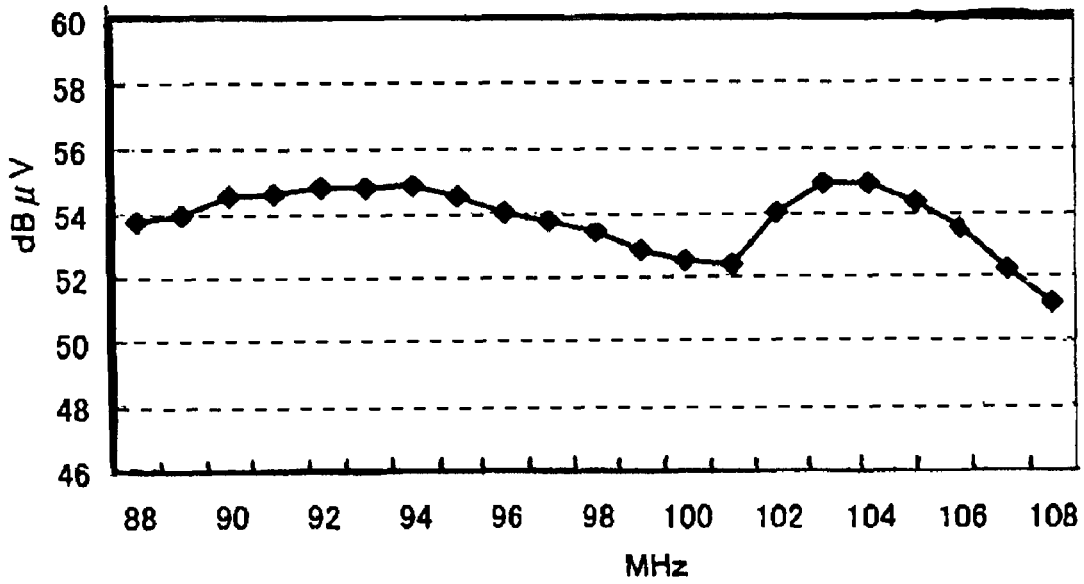
FIG. 9 is a view showing frequency vs. antenna gain characteristic of vertically polarized waves in FIG. 9.
Figure 11:
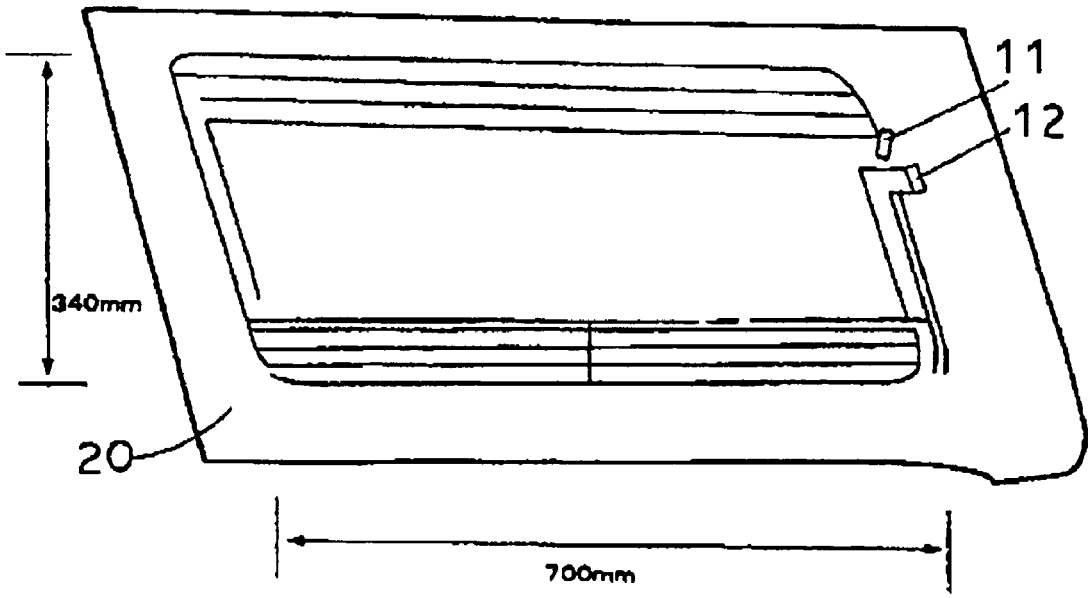
FIG. 11 is a front view showing another example of conventional glass antenna.

Using a left side rear-position side-window glass sheet, which was mounted on an to automobile body opening edge of the rear-position side-window of the automobile, an automobile high frequency glass antenna shown in FIG. 11 was produced. FIG. 9 shows the frequency vs. antenna gain characteristic of vertically polarized waves.

Industrial Applicability

The present invention is usable as an automobile glass antenna for receiving the terrestrial digital TV broadcasting, analogue TV broadcasting in the UHF band in Japan, digital TV broadcasting in US, digital TV broadcasting in EU region or digital TV broadcasting in the People's Republic of China, in the high frequency band, and is also applicable to the AM broadcast band.

Besides these, the present invention is also usable for Japanese FM broadcast band (76 to 90 MHz), US FM broadcast band (88 to 108 MHz), TV VHF band (90 to 108 MHz, 170 to 222 MHz), 800 MHz band for mobile phone (810 to 960 MHz) and automobile keyless entry system (300 to 450 MHz), in the high frequency band.

The entire disclosures of Japanese Patent Application No. 2007-155400 filed on Jun. 12, 2007 and Japanese Patent Application No. 2007-221214 filed on Aug. 28, 2007 including specifications, claims, drawings and summaries are incorporated herein by reference in their entireties.

The invention claimed is:

1. A side window glass antenna for an automobile, which is a glass antenna provided in or on an automobile side window glass sheet, and which comprises an H-band antenna conductor for receiving electric waves in a high frequency band, an H-band feeding portion that is connected with the H-band antenna conductor in terms of direct current and provided in the vicinity of an automobile body opening edge on the left or right side of the window glass sheet and an independent conductor, separately from the H-band antenna conductor, that is not connected with the H-band feeding portion in terms of direct current is provided in or on the window glass sheet; wherein the H-band antenna conductor is provided outside the independent conductor and capacitively coupled with at least a part of antenna elements forming an outline of the independent conductor; the independent conductor comprises a first antenna element extending in a vertical direction or substantially in the vertical direction and a plurality of second antenna elements extending in a transverse direction or substantially in a transverse direction; and the first antenna element extends vertically across the plurality of second antenna elements in the vicinity of the center in a left-right direction so as to be connected with each of the second antenna elements, and wherein the plurality of second antenna elements are provided in the vicinity of the upper end or in the vicinity of the lower end of the window glass sheet other than the vicinity of the center in the vertical direction; and wherein no element extending in the transverse direction is present in the vicinity of the center in the vertical direction in the area opposite to the side on which the H-band feeding portion is provided.

2. The side window glass antenna for an automobile according to claim 1, wherein the H-band antenna conductor has an extension portion extending upwardly along the outline of the independent conductor from the H-band feeding portion, and the extension portion is capacitively coupled with the independent conductor.

3. The side window glass antenna for an automobile according to claim 2, wherein the independent conductor further comprises a single or a plurality of first vertical auxiliary antenna elements provided between the first antenna element and the H-band feeding portion and extending in parallel or substantially in parallel with the first antenna element, and the first vertical auxiliary antenna elements extend vertically across the plurality of second antenna elements to be connected with each of the second antenna elements.

4. The side window glass antenna for an automobile according to claim 2, wherein the plurality of second antenna elements are provided in the vicinity of the upper end or in the vicinity of the lower end of the window glass sheet other than the vicinity of the center in the vertical direction.

5. The side window glass antenna for an automobile according to claim 2, wherein the independent conductor further comprises a single or a plurality of second vertical auxiliary antenna elements provided in a region of the window glass sheet opposite to the H-band feeding portion across the first antenna element and extending in parallel or substantially in parallel with the first antenna element, and the second vertical auxiliary antenna elements extend vertically across the plurality of second antenna elements to be connected with each of the second antenna elements.

6. The side window glass antenna for an automobile according to claim 2, wherein the H-band antenna conductor is a loop-shaped conductor having a loop shape or a loop-shaped conductor constituting a loop shape in combination with the H-band feeding portion.

7. The side window glass antenna for an automobile according to claim 2, wherein the independent conductor is an L-band antenna conductor for receiving electric waves in a low frequency band having a lower frequency than the high frequency band, and the glass antenna further comprises an L-band feeding portion that is connected with the L-band antenna conductor in terms of direct current and provided in proximity to the H-band feeding portion.

8. The side window glass antenna for an automobile according to claim 1, wherein the independent conductor further comprises a single or a plurality of first vertical auxiliary antenna elements provided between the first antenna element and the H-band feeding portion and extending in parallel or substantially in parallel with the first antenna element, and the first vertical auxiliary antenna elements extend vertically across the plurality of second antenna elements to be connected with each of the second antenna elements.

9. The side window glass antenna for an automobile according to claim 8, wherein the independent conductor further comprises a single or a plurality of transverse auxiliary antenna elements extending in parallel or substantially in parallel with the second antenna elements from a portion of the window glass sheet in the vicinity of the automobile body opening edge on the side of the glass sheet on which the H-band feeding portion is provided, to the first vertical auxiliary antenna element or the first antenna element.

10. The side window glass antenna for an automobile according to claim 9, wherein the independent conductor further comprises a third antenna element extending in the vertical direction or substantially in the vertical direction so as to connect at least two of: the ends or their vicinities on the H-band feeding portion side of the plurality of second antenna elements and the ends or their vicinities on the H-band feeding portion side of the single or the plurality of vertical auxiliary antenna elements, to each other.

11. The side window glass antenna for an automobile according to claim 10, wherein the third antenna element has a discontinuous portion at at least one of adjacent connections in the at least two connections with the ends or their vicinities on the H-band feeding portion side of the plurality of second antenna elements and the ends or their vicinities on the H-band feeding portion side of the transverse auxiliary antenna elements.

12. The side window glass antenna for an automobile according to claim 1, wherein the independent conductor further comprises a single or a plurality of second vertical auxiliary antenna elements provided in a region of the window glass sheet opposite to the H-band feeding portion across the first antenna element and extending in parallel or substantially in parallel with the first antenna element, and the second vertical auxiliary antenna elements extend vertically across the plurality of second antenna elements to be connected with each of the second antenna elements.

13. The side window glass antenna for an automobile according to claim 1, wherein the H-band antenna conductor is a loop-shaped conductor having a loop shape or a loop-shaped conductor constituting a loop shape in combination with the H-band feeding portion.

14. The side window glass antenna for an automobile according to claim 1, wherein provided that the wavelength at the central frequency of the high frequency band in the air is $\lambda_0$, the shortening coefficient of wavelength by glass is k, the formula of k=0.64 is established, the formula of $\lambda_g=\lambda_0 \cdot k$(is established, and a portion wherein the H-band antenna conductor is capacitively coupled with the independent conductor is designated as a capacitive coupling portion, then, the length of the capacitive coupling portion is from 0.05 $\lambda_g$ to $0.2\lambda_g$.

15. The side window glass antenna for an automobile according to claim 1, wherein provided that the wavelength at the central frequency of the high frequency band in the air is $\lambda_0$, the shortening coefficient of wavelength by glass is k, the formula of k=0.64 is established, the formula of $\lambda_g=\lambda_0 \cdot k$ is established, then, the conductor length of the second antenna element from the first antenna element to the vicinity of the H-band feeding portion is $(1/11)\lambda_g$ to $(1/4)\lambda_g$.

16. The side window glass antenna for an automobile according to claim 1, wherein provided that the wavelength at the central frequency of the high frequency band in the air is $\lambda_0$, the shortening coefficient of wavelength by glass is k, the formula of k=0.64 is established, the formula of $\lambda_g=\lambda_0 \cdot k$ is established, then, the total length of the conductor length of the H-band antenna conductor, that is defined as the conductor length to the turning point of the loop shape when the H-band antenna conductor is a loop-shaped conductor, and the length of an audio or video line, that is connected with the H-band feeding portion, is from $(1/8)\lambda_g$ to $(1/2)\lambda_g$.

17. The side window glass antenna for an automobile according to claim 1, wherein the independent conductor is an L-band antenna conductor for receiving electric waves in a low frequency band having a lower frequency than the high frequency band, and the glass antenna further comprises an L-band feeding portion that is connected with the L-band antenna conductor in terms of direct current and provided in proximity to the H-band feeding portion.

18. The side window glass antenna for an automobile according to claim 17, wherein the minimum distance between the H-band feeding portion and the L-band feeding portion is from 3 to 50 mm.

19. A side window glass sheet for an automobile provided with the side window glass antenna as defined in claim 1.

20. The side window glass antenna for an automobile according to claim 1, wherein the side window glass sheet does not include a defogging window heating conductor field.

21. The side window glass antenna for an automobile according to claim 1, wherein the glass antenna comprises one or more transverse auxiliary antenna elements that extends in a region of the glass sheet on the side on which the H-band feeding portion is provided, wherein the transverse auxiliary antenna elements are oriented substantially parallel to the second antenna elements and do not extend across the first antenna element.

* * * * *